US007013585B2

(12) United States Patent
Lo

(10) Patent No.: US 7,013,585 B2
(45) Date of Patent: Mar. 21, 2006

(54) CUSHION DEVICE FOR SHOES

(76) Inventor: Chie-Fang Lo, No. 11, Alley 7, Lane 715, Dong Ping Rd., Tai-Ping City, Taichung County (TW)

( * ) Notice: Subject to any disclaimer, the term of this patent is extended or adjusted under 35 U.S.C. 154(b) by 0 days.

(21) Appl. No.: 10/916,390

(22) Filed: Aug. 12, 2004

(65) Prior Publication Data

US 2006/0032089 A1 Feb. 16, 2006

(51) Int. Cl.
*A43B 13/20* (2006.01)

(52) U.S. Cl. ..... 36/29

(58) Field of Classification Search ..... 36/29, 36/3 B, 35 B

See application file for complete search history.

(56) References Cited

U.S. PATENT DOCUMENTS 4,446,634 A * 5/1984 Johnson et al. ..... 36/29
4,991,317 A * 2/1991 Lakic ..... 36/44
5,343,637 A * 9/1994 Schindler ..... 36/28
6,463,679 B1 * 10/2002 Buttigieg ..... 36/3 B
6,510,624 B1 * 1/2003 Lakic ..... 36/29
6,553,691 B1 * 4/2003 Huang ..... 36/29
2002/0050074 A1 * 5/2002 Ricco et al. ..... 36/3 R

* cited by examiner

*Primary Examiner*—Ted Kavanaugh

(57) ABSTRACT

A cushion device for shoes includes a first bladder and a second bladder with a hose connected in communication therebetween. A compressible unit is received in the second bladder and has an outgoing hose extending therefrom. The outgoing hose is connected to an inlet of the first bladder. An inlet hose has an end located outside of the second bladder and the other end of the inlet hose is connected to the compressible unit. The wearer compresses the compressible unit to inflate the first and second bladders. When the load is disappeared from the compressible unit, air is sucked from the inlet hose to assist the compressible unit to return to the original status.

2 Claims, 7 Drawing Sheets

CUSHION DEVICE FOR SHOES

FIELD OF THE INVENTION

The present invention relates to a cushion device including a bladder connected with a compressible unit which forces air to inflate the bladder to absorb the load.

BACKGROUND OF THE INVENTION

A conventional cushion device installed in shoes is generally made by foam material which has small spring coefficient and cannot provide sufficient cushion feature. Besides, the foam member used as the cushion device reacts too slow when the wearer is jogging and the air that is squeezed out from the foam member is trapped in a limited area so that the foam member is suffered by a large pressure which reduces the rate of bouncing of the foam member.

The present invention intends to provide a cushion device for shoes and the bladder of the cushion device reacts quickly to absorb shocks and provides better cushion feature.

SUMMARY OF THE INVENTION

The present invention relates to a cushion device that comprises a bladder assembly including a first bladder and a second bladder. A hose is connected in communication between the first bladder and the second bladder. The second bladder has a compressible unit received therein and an outgoing hose extending from the compressible unit is connected to an inlet of the first bladder. An inlet hose has an end located outside of the second bladder and the other end of the inlet hose is connected to the compressible unit.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
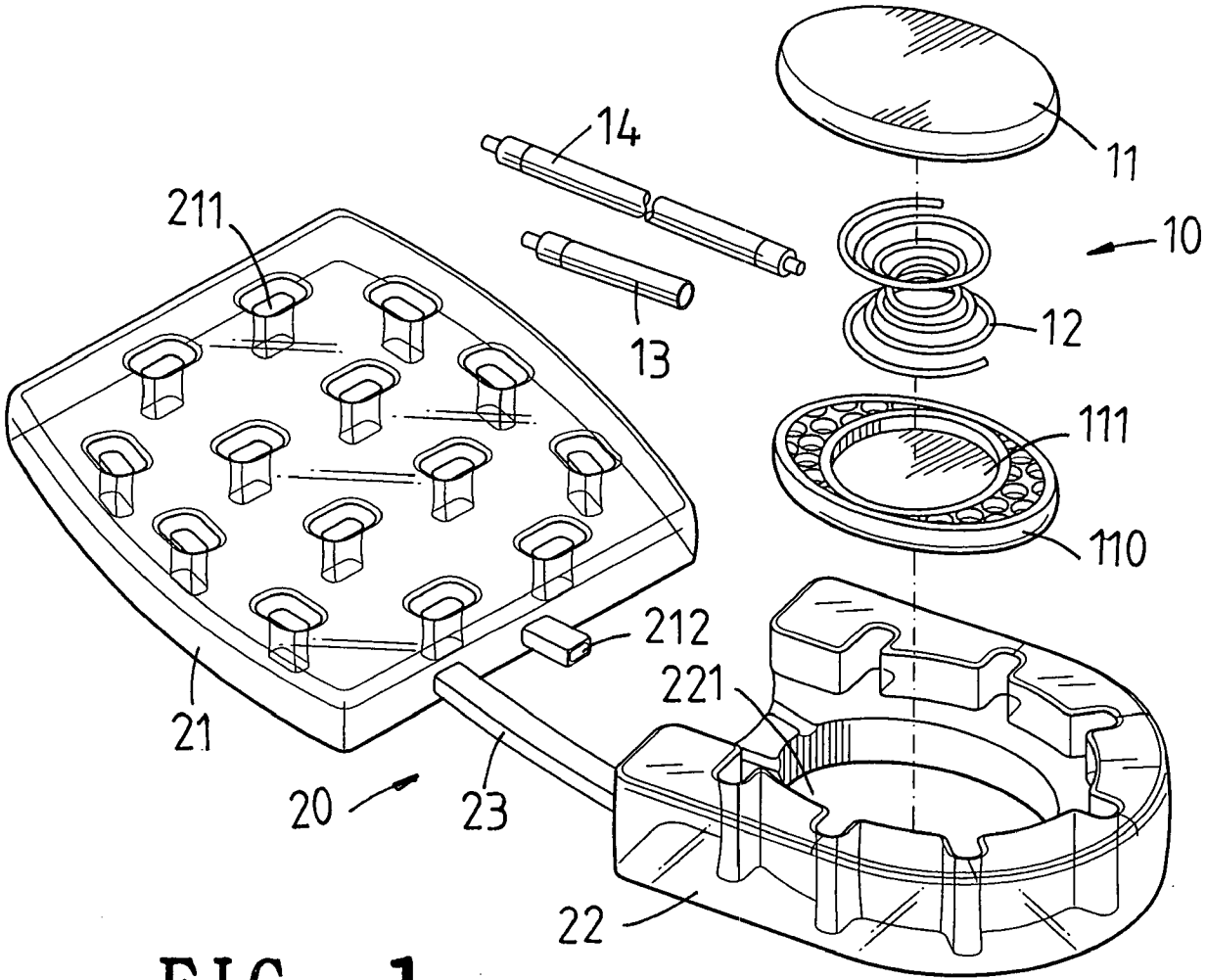
FIG. 1 is an exploded view to show the cushion device of the present invention.
Figure 2:
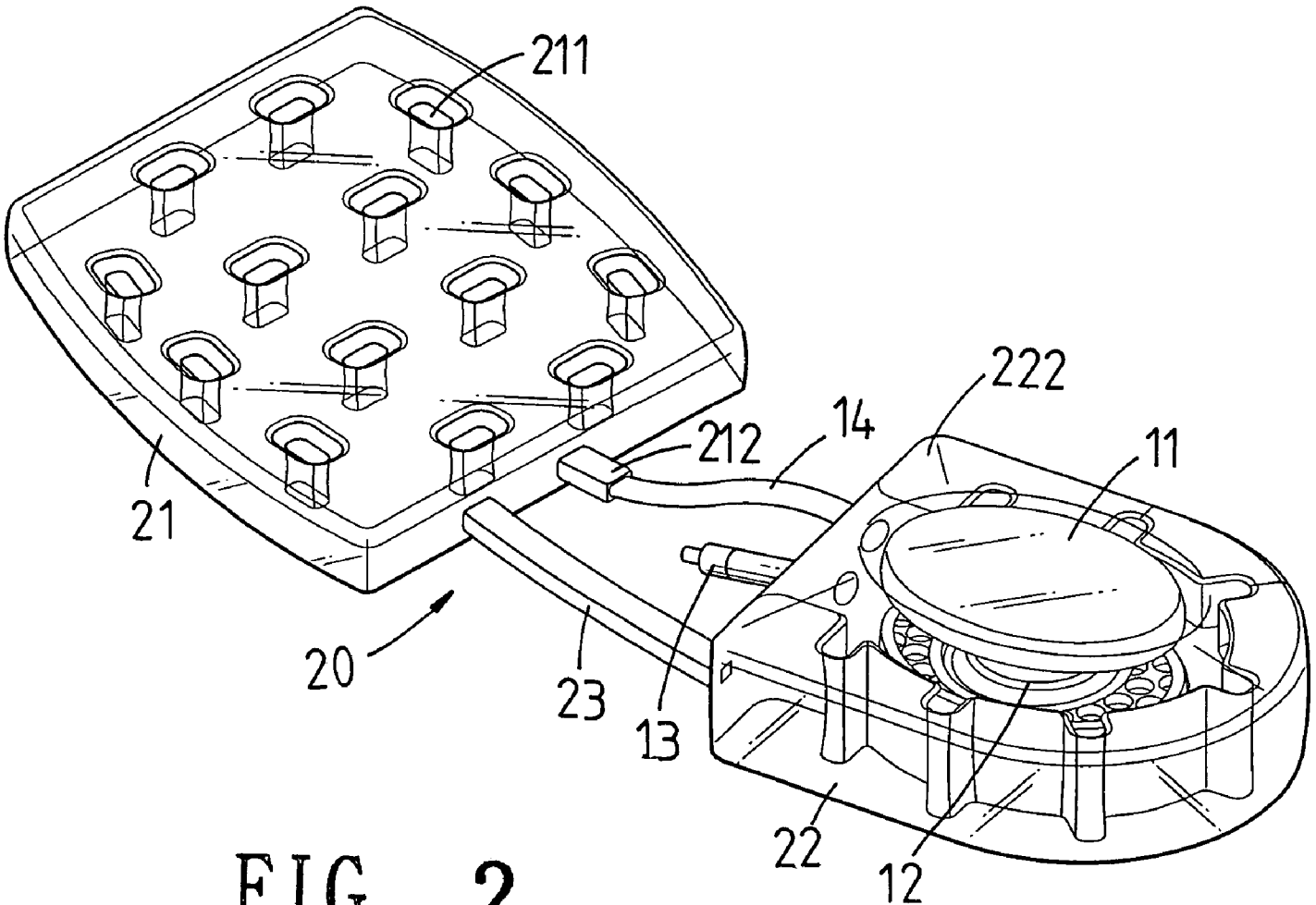
FIG. 2 is a perspective view of the cushion device of the present invention.
Figure 3:
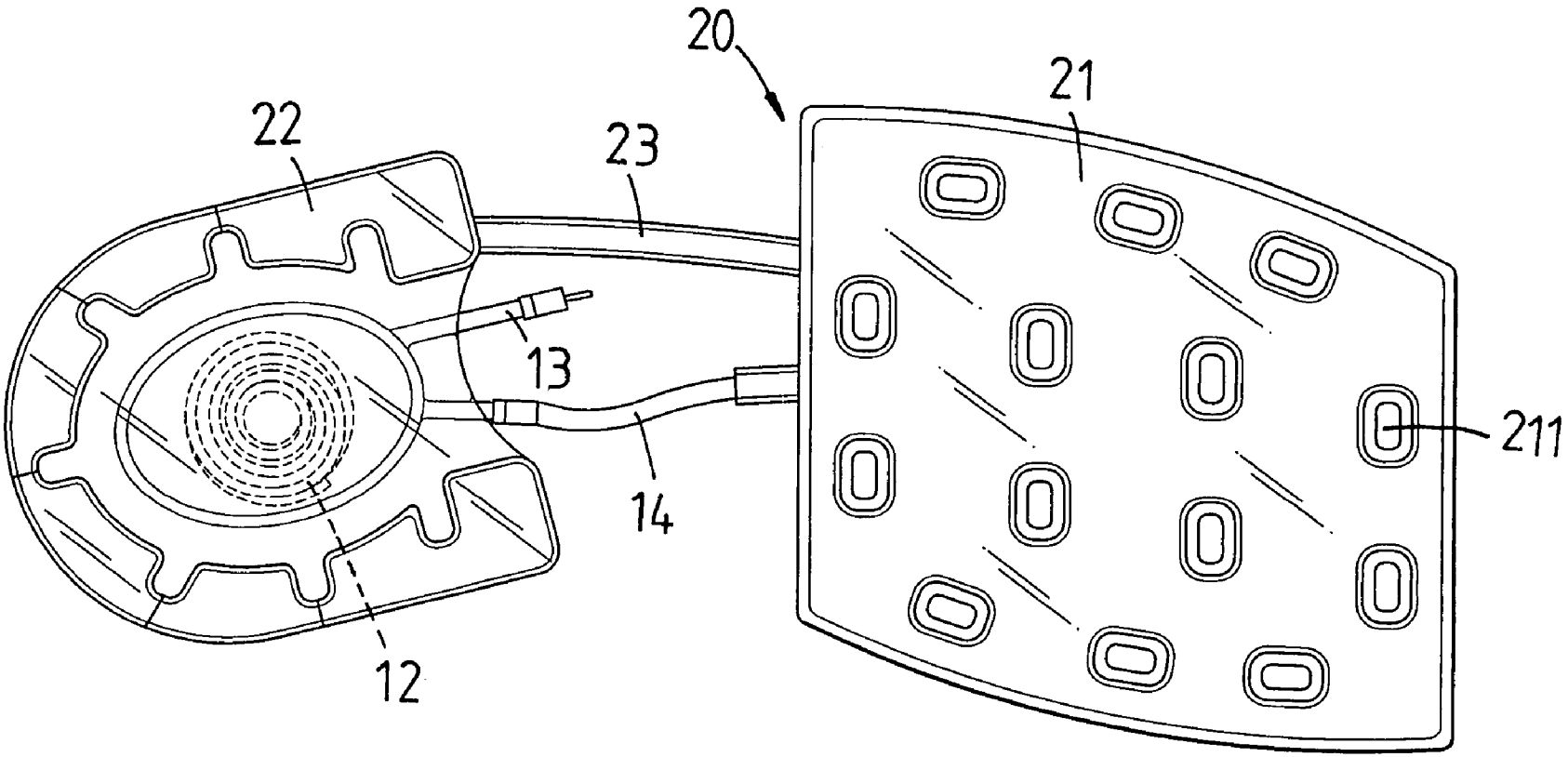
FIG. 3 is a top view of the cushion device of the present invention.
Figure 4:
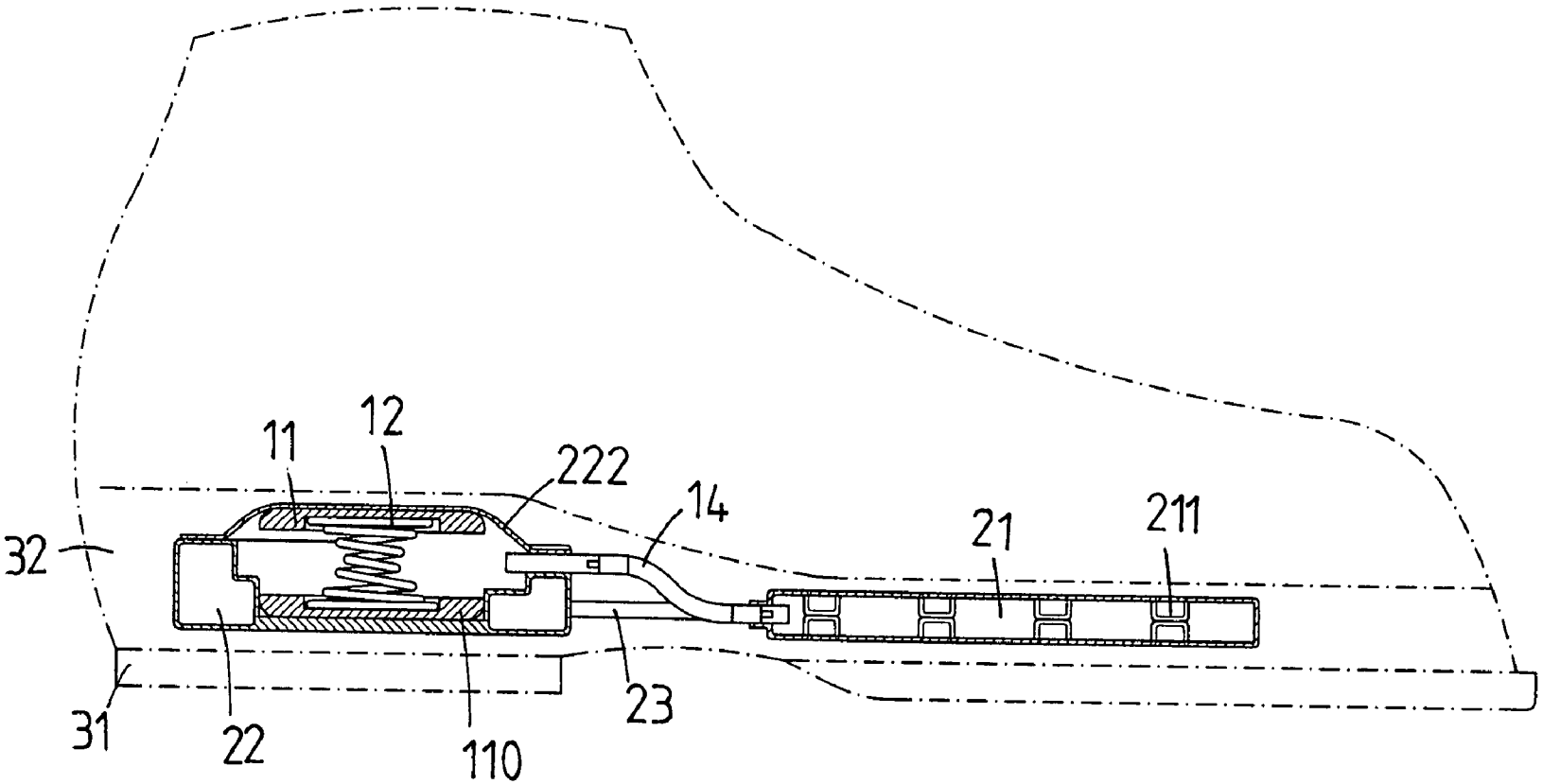
FIG. 4 is a side cross sectional view of the cushion device of the present invention, wherein no load is applied to the compressible unit.

Referring to FIGS. 1 to 4, the cushion device for shoes of the present invention comprises a bladder assembly 20 including a first bladder 21 and a second bladder 22. A hose

23 is connected in communication between the first bladder 21 and the second bladder 22. The first bladder 21 includes a plurality of columns 211 connected between a top and a bottom of the first bladder 21 so as to reinforce the structural strength of the first bladder 21. The second bladder 22 has a chamber 221 in which a compressible unit 10 is received and a seal 222 seals chamber 211. An outgoing hose 14 extends from the compressible unit 10 and is connected to an inlet 212 of the first bladder 21. An inlet hose 13 has an end located outside of the second bladder 22 and the other end of the inlet hose 13 is connected to the compressible unit 10.

The compressible unit 10 includes a top pad 11, a bottom pad 110 and a spring 12 is connected between the top pad 11 and the bottom pad 110. Each of the top pad 11 and the bottom pad 110 includes a recess 111, and two ends of the spring 12 are respectively engaged with the two recesses 111 in the top pad 11 and the bottom pad 110. The spring 12 is a funnel-shaped spring with two enlarged ends and a narrow middle portion, so that the spring 12 is allowed to be compressed as shown in FIG. 5 without interruption.

Figure 5:
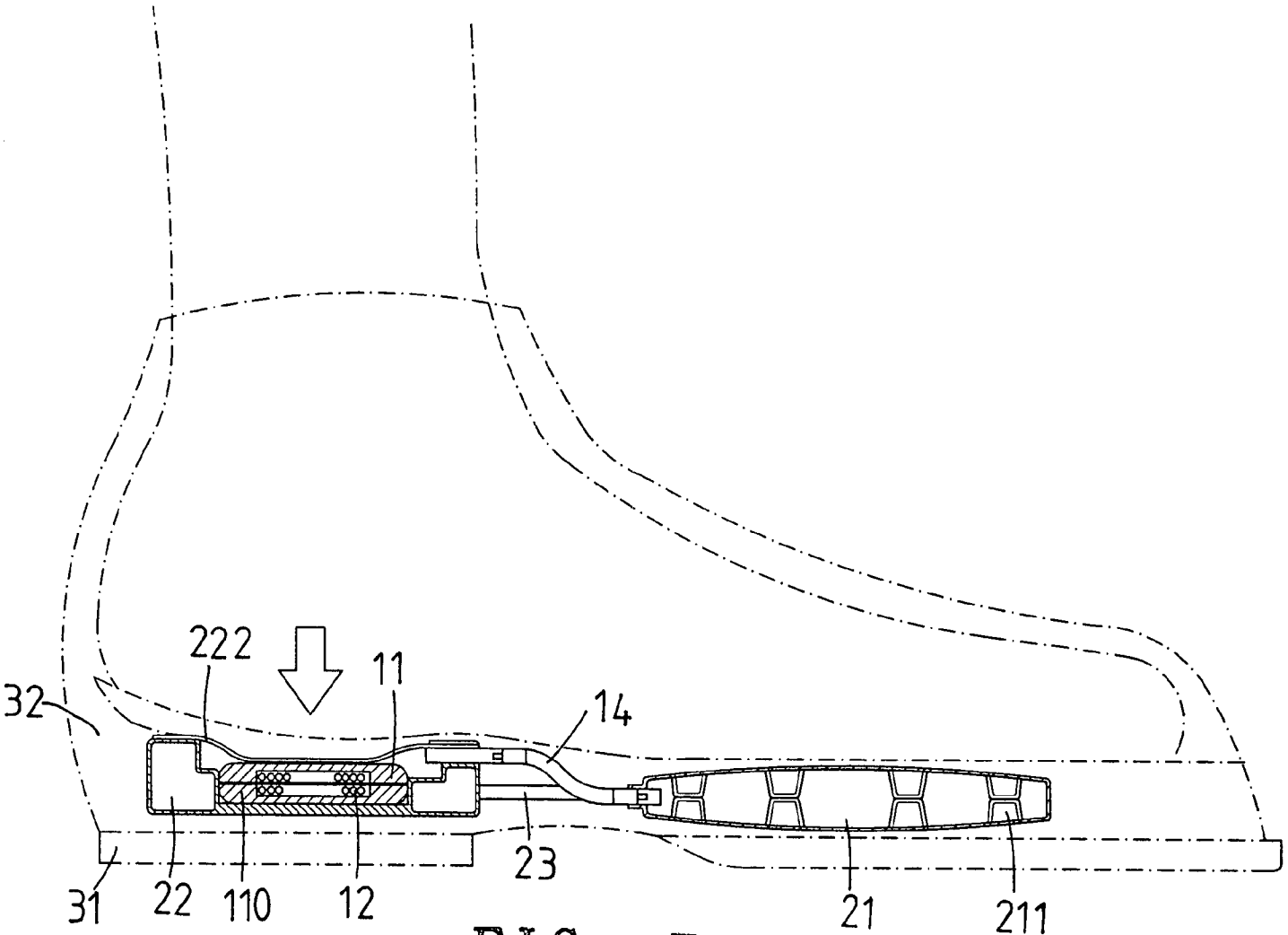
FIG. 5 is a side cross sectional view of the cushion device of the present invention, wherein a load is applied to the compressible unit.

As shown in FIG. 5, when the wearer applies his or her weight on the compressible unit 10, air in the chamber 221 is pushed into the outgoing hose 14 and enters the first bladder 21 and the second bladder 22 via the hose 23. The inflation of the first and second bladders 21, 22 provides a comfortable wearing and absorbs shocks during jogging or walking. When the load is removed from the compressible unit 10, the spring 12 bounces the top pad 11 upward and air is sucked into the chamber 221 via the inlet hose 13 such that the cushion device is ready for the following load.

Figure 6:
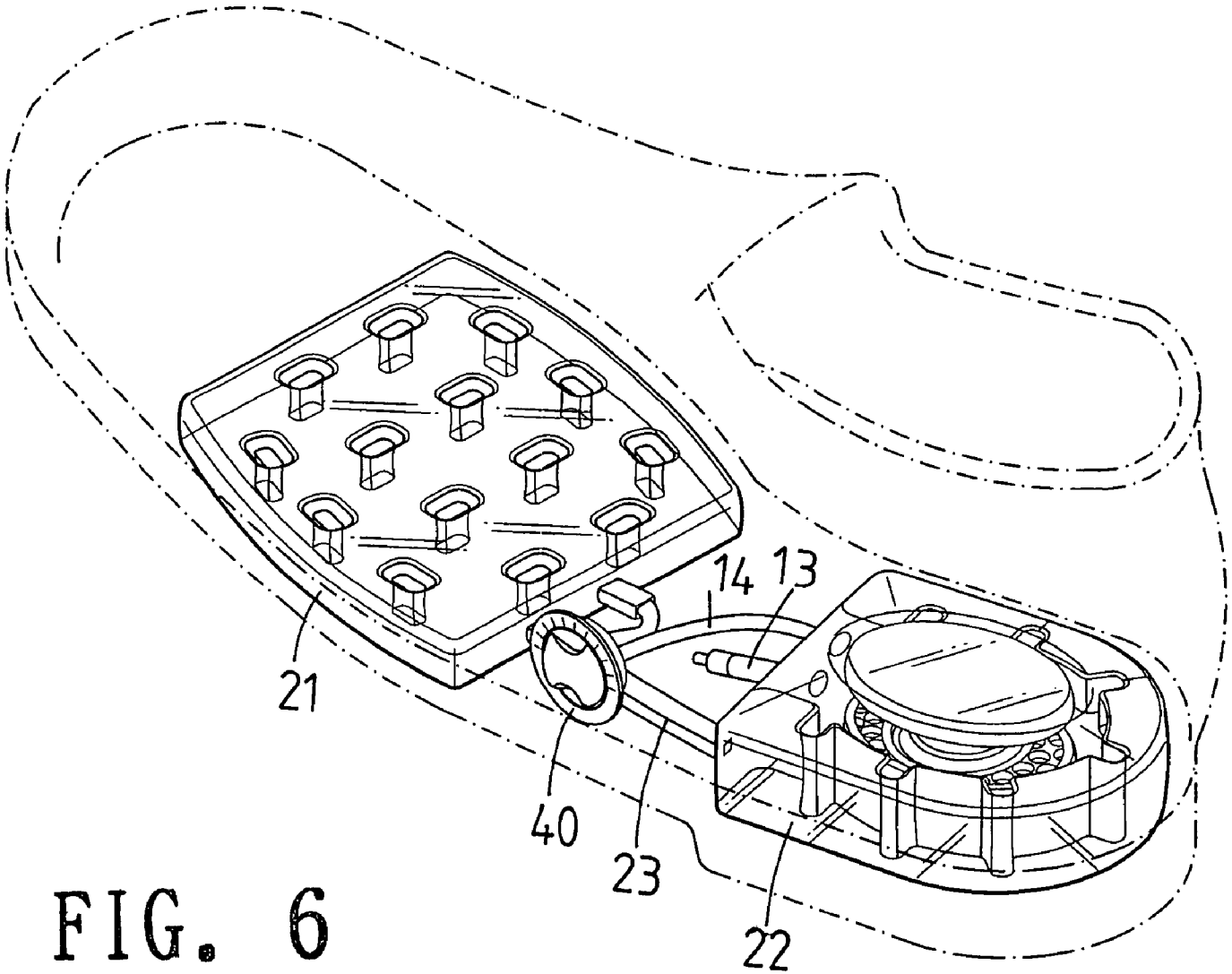
FIG. 6 is a perspective view to shows that a valve is connected to the outgoing hose.
Figure 7:
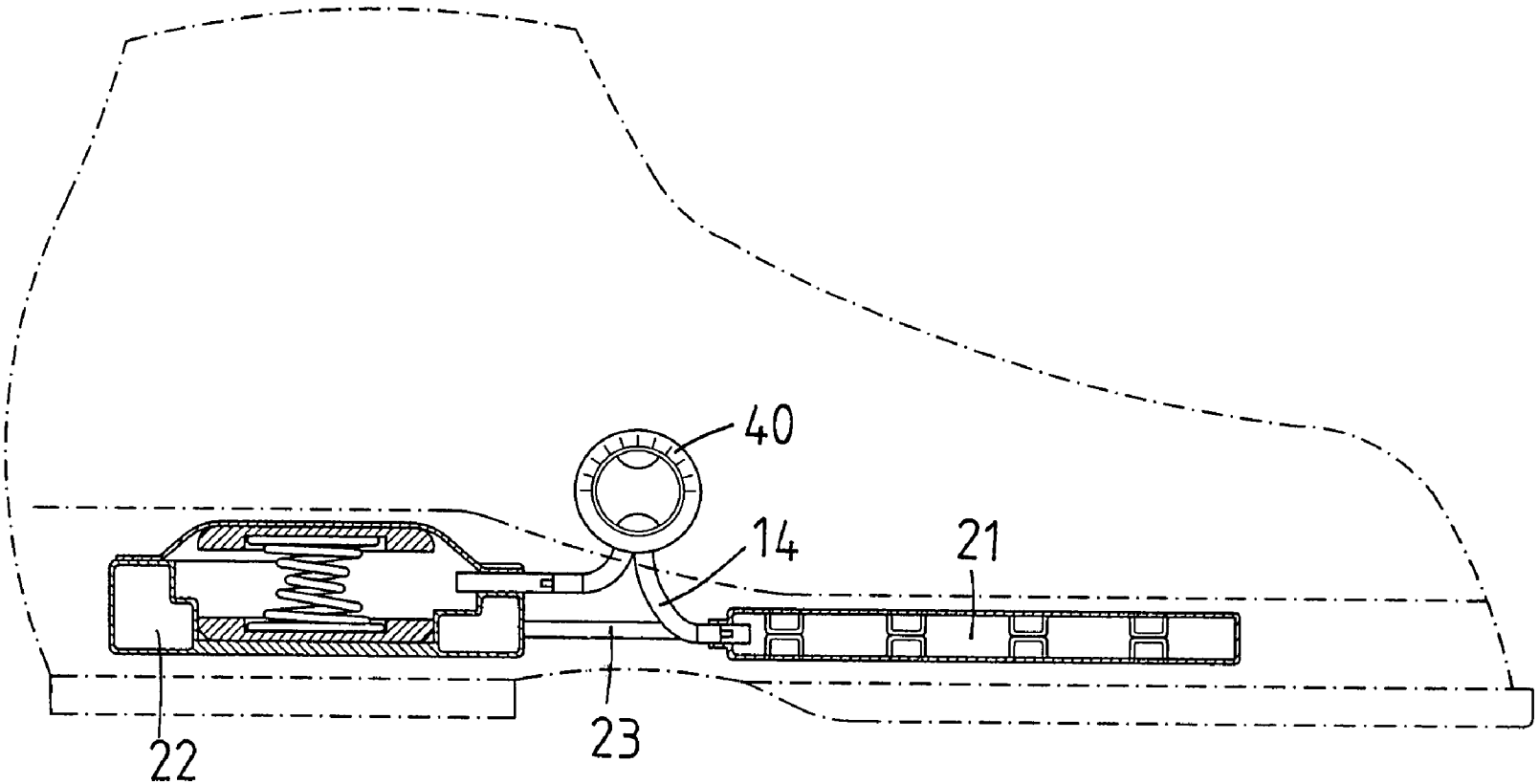
FIG. 7 is a side cross sectional view of the embodiment in FIG. 6.

Referring to FIGS. 6 and 7, a valve 40 is connected to the outgoing hose 14 and can be accessible from outside of the shoe such that the user may operate the valve 40 to control the volume of air flowing in the outgoing hose 14. This allows the user to adjust the stiffness of the bladders 21, 22 according to practical needs.

While we have shown and described the embodiment in accordance with the present invention, it should be clear to those skilled in the art that further embodiments may be made without departing from the scope of the present invention.

What is claimed is:

1. A cushion device comprising:

a bladder assembly including a first bladder and a second bladder, a hose connected in communication between the first bladder and the second bladder, the first bladder including a plurality of columns connected between a top and a bottom of the first bladder, the second bladder having a compressible unit received therein, the compressible unit including a top pad and a bottom pad, a spring connected between the top pad and the bottom pad and the spring being a funnel-shaped spring with two enlarged ends and a narrow middle portion, each of the top pad and the bottom pad including a recess, the two enlarged ends of the spring respectively engaged with the two recesses in the top pad and the bottom pad, an outgoing hose extending from the compressible unit and connected to an inlet of the first bladder, an inlet hose having an end located outside of the second bladder and the other end of the inlet hose connected to the compressible unit.

2. The device as claimed in claim 1, wherein a valve is the outgoing hose.

* * * * *